United States Patent [19]

Krakauer

[11] 4,371,153

[45] Feb. 1, 1983

[54] SINUOUS SPRING WITH DEPTH CONTROL

[75] Inventor: Daniel Krakauer, Great Neck, N.Y.

[73] Assignee: Kay Springs, Inc., Syosset, N.Y.

[21] Appl. No.: 192,947

[22] Filed: Oct. 2, 1980

[51] Int. Cl.[3] ..... F16F 3/02

[52] U.S. Cl. ..... 267/105; 267/110

[58] Field of Search ..... 267/86, 87, 85, 89, 267/103, 104, 105, 110, 111, 112

[56] References Cited

U.S. PATENT DOCUMENTS

| | | | |
|---|---|---|---|
| 2,657,740 | 11/1953 | Daniels et al. | 267/105 |
| 2,731,075 | 1/1956 | Flint | 267/105 |
| 2,897,879 | 8/1959 | Brown et al. | 267/105 |
| 2,916,087 | 12/1959 | Laitur | 267/104 |
| 2,936,821 | 5/1960 | Neely | 267/105 |
| 3,248,745 | 5/1966 | Gunlock | 267/105 |
| 4,247,089 | 1/1981 | Crosby et al. | 267/105 |

FOREIGN PATENT DOCUMENTS

| | | | |
|---|---|---|---|
| 886579 | 1/1962 | United Kingdom | 267/103 |

*Primary Examiner*—Duane A. Reger

[57] ABSTRACT

A prestressed sinuous spring for furniture springing in which the upwardly spanned are or contour is loaded and depressed to a modified depth and contour by incorporating and selectively positioning a reinforcing link with the prestressed sinuous spring to resist tension and bending forces to which the prestressed sinuous spring is subjected upon loading between the ends thereof.

10 Claims, 5 Drawing Figures

SINUOUS SPRING WITH DEPTH CONTROL

BACKGROUND AND OBJECTIVES OF THE PRESENT INVENTION

Pre-arced sinuous springs have become dominant in furniture springing since they were introduced in the 1930's of the type disclosed in U.S. Pat. No. Re. 21,263 of Kaden. It is estimated that 250 million feet of sinuous spring is installed yearly in furniture in the United States alone. In addition to simple applications in which several parallel sinuous strands of 8 to 10 gauge spring wire span the seats of furniture, and in which lighter gauges span the backs, many ways have been discovered utilizing various formats, arcs, and superimposed bends and attachments to produce a different springing effect required by individual furniture manufacturers.

One of the more difficult effects to achieve with sinuous springing is to provide suitable "soft" springing in which the occupant sinks four or more inches in the chair upon which the occupant is seated. This difficulty occurs because most of the inherent arc of the sinuous spring is flattened when the spring is stretched into place. This flattening prestresses the spring and affords a highly desirable initial resistance to the sitter. At the same time, however, the stretching and flattening use up to a considerable extent the available elasticity in the spring, so that only a few inches of downward movement or "ride" are available before exceeding the elastic limit of the spring.

It would appear logical when a larger amount of ride is desirable that a longer spring should be used for the same span. By providing a longer spring for the same span, the sinuous spring would arch higher in the middle of the span when the spring is stretched into place. The longer spring would have more unused elasticity available and would be depressed further under load. However, this solution does not usually work satisfactorily. Highly arched sinuous springs are under insufficient tension and become excessively soft to resist the load to which the spring is subjected in mid-span. They will depress excessively in the center when sat upon, and provide the occupant with the feeling that he is sitting in an upholstered bucket. In fact, the term "bucketing" has become common terminology in the furniture industry to describe this objectionable effect.

When an increased or greater amount of "ride" is desirable, in seats of average length, e.g. about 25 inches, a hinging link, which is well known in the furniture art and has been used for approximately forty years, is often placed in the rear of the frame between the spring strand or linear cross bar and the attachment clip that is fastened to the rear rail or frame. The hinging link is maintained in a horizontal position by the tension of the sinuous spring when the seat is unoccupied. When the seat is occupied, the hinging link pivots downwardly and provides considerable "ride" supplementing the action of the sinuous spring.

Another effective system for increasing the extent of "ride" is disclosed in U.S. Pat. No. 3,096,086 in which a sinuous wire spring utilizes a downwardly bent leg at or near the rear attachment clip. When the sinuous spring is depressed, the downward leg pivots inwardly and forces the sinuous spring to dip over much of its length as it depresses under load from its upwardly arched relaxed condition. Such springs can be designed with varying angles and lifts of the downward leg which pivots about a rail supported clip. Also, "hinge" links may be combined with the downward leg for more added movement under load conditions.

However, the systems mentioned above do not function as well in very long seats that require elongated sinuous springs which may be 25 inches or longer. When a long spring is installed with a hinge link, the pivoting of the link in the rear clip is usually not great enough to provide a substantial increase of downward movement in the mid-portion of the sinuous spring. In the approach shown in U.S. Pat. No. 3,096,086, in which full tension must be avoided, long strands may tend to bucket and produce an excessive depression in the center of the strand.

Various devices have evolved for increasing the ride in long springs, and one example is shown in U.S. Pat. No. 3,210,064. The rear end of each sinuous strand in the latter patent hooks into a separate steel stamping approximately 4½ inches long and 1 inch wide, or one of the other embodiments illustrated therein, by means of which the rear section of the sinuous strand is connected to various spring or hinge link devices or a combination thereof. According to the latter patent, "A highly desirable amount of torque is thus imparted to the spring band 20 with little strain on any single point in the band 20." (column 4, lines 67–69) By utilization of an intermediary device as described in the latter patent, there is apparently offered resistance to bucketing as the spring band depresses under load.

It has been determined that because of the arc that is formed into prearced sinuous springs, they do not act like a spring in simple tension. The art typically is formed with a radius of 4 inches to 5 inches. When stretched into place, as noted previously, the arc radius is necessarily increased. However, the internal forces from the arc oppose the flattening forces that occur when the spring is stretched under tension. The response of the sinuous spring to the various forces varies along the length of the span, for reasons that will be noted hereafter.

When the two ends of a springy arch are pulled apart, it may be readily understood that bending moments occur in the arched spring. The moments developed from each end are in opposite directions, one clockwise and one counterclockwise, and produce forces that flatten the inherent arc as the spring is hooked in position. These forces are greatest where the lever arms are longest, e.g. at the mid-span. From mid-span in either direction, the moments decrease in relation to the distance from the point of attachment, reaching zero at the attachment point or position.

This effect is visible in all arced springs in situ. The mid-span is flat and is the softest spot in the span. Adjacent to each end, part of the arc radius remains, which becomes less and less flattened as it approaches the point of attachment. As a result, the mid-span is always higher in the arched position than the point of attachment and appears as though the medial portion was standing on two bowed legs. When a load is applied over most of the span in this type of spring installation, the ends resist deflection more than the mid-span and never deflect to the same extent as the center of the sinuous spring. The shape and positioning of the occupant compounds the situation by placing the greatest load in the mid-span of the upwardly arched sinuous spring.

The force of tension to which the entire sinuous spring span is subjected opposes the softening and reverse bending effect on the center. This stress also results from the stretching of the spring into its retained position on the frame. It is for this reason that the center of the span of the prestressed sinuous spring is essentially flat and not concave.

Both the bending and the tensile stresses are increased by the weight and shape of the occupant. As the occupant's weight is applied, the spring stretches, the remaining radii at each end of the span flatten further, and the center of the span becomes concave. However, the combined stresses reach their elastic limit before the ends flatten. As a result, the loaded sinuous spring appears in outline form to be similar to a cupid's bow. Long spans, like short spans, sit very well with standard installations under adequate tension. When a deeper "ride" is desirable, and longer springs with less tension are employed, the cupid's bow effect becomes exaggerated and the over-long arced springs will "bucket" in the center when sat upon.

The present invention provides a new and simpler method of stabilizing relatively long spans of prearced sinuous springs.

Another objective of this invention is to provide a reduction in the flexibility of a portion of a span in a prearced sinuous spring thereby creating the effect of a shorter span.

Still another objective of the present invention is the provision of a simple and low cost solution to achieving a deep ride without objectionable bucketing by controlling the flattening of the prearced sinuous spring span particularly in longer seating spans.

Still a further object of this invention is the provision of a prestressed sinuous spring fastened at its ends to provide an upwardly arched contour forming a span between the front and rear of a seat in the unloaded condition with a contour control means for selectively positioning to said sinuous spring intermediate its ends to modify the contour of the sinuous spring for improved depth and firmness without objectionable bucketing or depression upon load application.

A still further objective of the present invention is to provide a prestressed sinuous spring in which the ultimate loaded contour may be programmed incrementally for the desired shape by selectively positioning a reinforcing member at appropriate intervals to a prestressed sinuous spring thereby controlling the ultimate contour under loaded conditions with minimal components and expense while achieving the requisite depth of seating particularly in extended lengths of the sinuous spring.

In accordance with a preferred embodiment of the present invention, a supplementary or reinforcing foreshortened sinuous spring segment is securely fastened to a portion of the prestressed sinuous spring intermediate its ends and spaced from a terminal end with the prestressed sinuous spring having its ends secured to the furniture frame, enabling the prestressed sinuous spring to have a modified deflection curve upon load application by limiting the elasticity of an intermediate portion of the sinuous spring by the foreshortened sinuous spring segment to obtain a greater depth of ride by controlling the flattening of the sinuous span without the use of any torque attachment secured to an end of the prestressed sinuous spring.

Other objectives and many of the advantages of this improved sinuous spring structure will become more apparent to those skilled in the spring art from a more detailed description of a preferred embodiment and the claims which are not intended for any limitation and mechanical equivalents are contemplated.

BRIEF DESCRIPTION OF DRAWING OF PREFERRED EMBODIMENT

Figure 4:
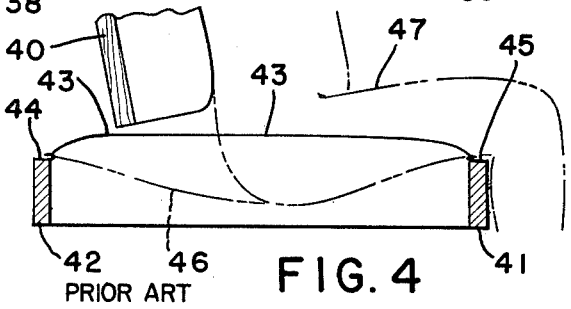
PRIOR ART FIG. 4
Figure 5:
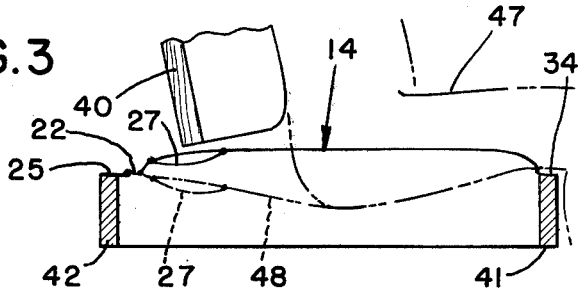

FIG. 4 is a schematic view of an elongated seat and a typical associated deep back with a prestressed sinuous spring secured to the front and rear rails illustrating in full line form the unloaded condition of the sinuous spring and the upwardly contoured arc and, in the loaded condition, the broken line deflected sinuous spring and portions of the occupant in a condition of objectionable overly deep ride and bucketing; and FIG. 5 is a schematic view of an elongated seat and a typical associated deep back with a prearced sinuous spring incorporating the present invention in the unloaded full line position with the upwardly extending arch and in the loaded broken line condition with the occupant shown in partial outline form and the loaded sinuous spring providing a modified contour with suitable depth of ride and without bucketing.

DETAILED DESCRIPTION OF A PREFERRED EMBODIMENT OF THE INVENTION

Figure 2:
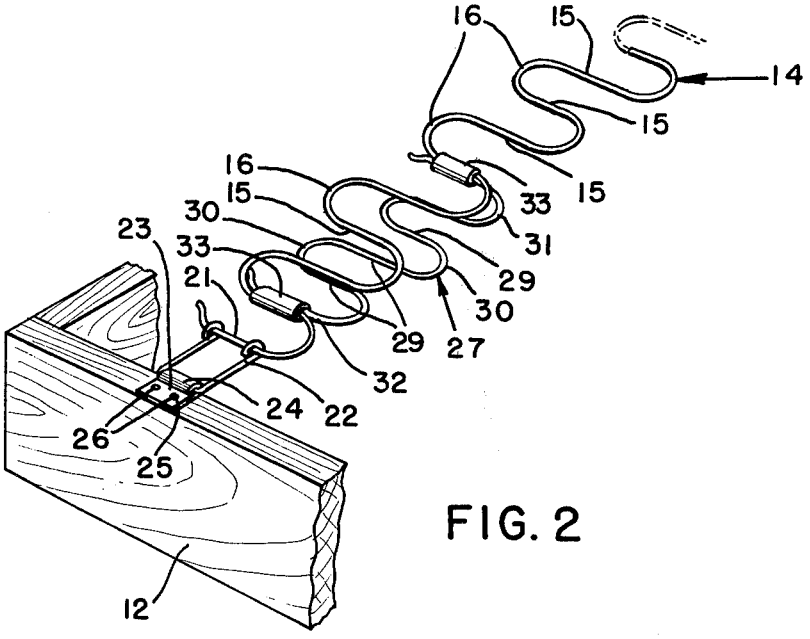
FIG. 2 is a partial perspective view of a corner portion of the furniture frame to which one end of the prearced sinuous spring is supported by a hinge link and clip connection to the rear rail in the unloaded condition.
Figure 1:
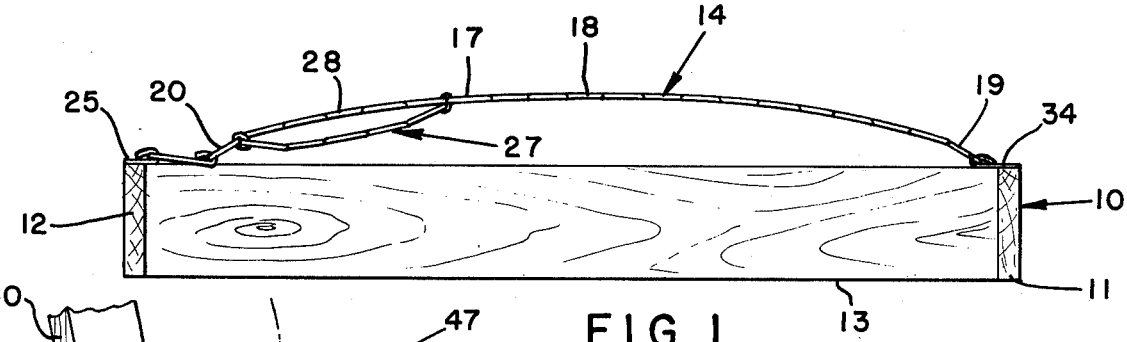
FIG. 1 is a sectional end elevational view of a single prearced or prestressed sinuous spring embodying the invention on a furniture frame and illustrating the combination with an auxiliary or reinforcing member eccentrically mounted thereon before load application.

Referring to the drawing and particularly to FIGS. 1, 2 and 5, there is illustrated in FIG. 1, a furniture frame 10 for springing in the form of a seat in which a front rail 11 and rear rail 12 are spaced from each other and supported by means of the end rail 13. It will be recognized that it is preferable to utilize the improvement of the present invention with a span between the front and rear rails 11 and 12 that is greater than 25 inches although it may be employed with satisfactory results for lesser spans.

The prestressed or prearced sinuous wire spring 14 is provided with a plurality of spaced linear cross-bars 15 which are connected continuously by oppositely extending semi-circular loops 16. Conventional sinuous wire springs 14 are prestressed or prearced at a smaller radius and when connected to a furniture frame, there is a customary upwardly extending flattened arch 17 which is relatively flat at the mid-span 18 with the terminal ends 19 and 20 having a tendency to bow downwardly adjacent to the terminal cross-bar end 21 (as shown in FIG. 1). The terminal cross-bar end 21 of the prearced sinuous wire spring 14 is illustrated in FIG. 2 as being connected to the rear rail 12 through the hinge link 22 which pivotally supports the cross-bar end 21. The hinge link 22 is pivotally fastened to the clip attachment 23 under the return bend of flat hook 24 with the flat portion 25 being mounted securely on the rail 12 by means of the nails 26 passed through the clip openings into the wood rail 12.

The construction thus far described is conventional and well-known in the art. However, in certain sinuous spring applications, and particularly for greater than normal length applications, a modification of the loaded contour may be achieved simply and inexpensively to obtain a firm deep seat without objectionable bucketing by the incorporation of a relatively short auxiliary reinforcing member 27 that is securely fastened to selected crossbars of the prestressed sinuous spring 14 for a suitable span thereby modifying the elastic properties or characteristics of the overlapped span in which the auxiliary reinforcing member 27 extends coincidentally with the span 28 of the prestressed sinuous wire spring.

The auxiliary reinforcing member 27, in the preferred embodiment, may also be a prestressed sinuous wire spring segment of the same gauge as the sinuous spring 14 except that it is preferably inverted or reversed so that it prevents a downward contour beneath the sinuous spring 14 as shown in FIG. 1 thereby avoiding any objectionable protrustion in the seating portion of the seat. The auxiliary reinforcing member 27 is also provided with linear cross-bars 29 and connecting semi-circular loops 30. The reinforcing member 27 is provided with terminal cross-bar ends 31 and 32 which may coincide with the cross-bars of the main sinuous wire spring 14 and be coincident therewith for a preselected span.

Suitable clinching sleeve members 33 securely clamp the selected cross-bar members 15 of the prestressed sinuous wire spring 14 with the cross-bars 31 and 32 of the reinforcing member 27. In the embodiment illustrated in FIGS. 1, 2 and 5, the auxiliary reinforcing member 27 is eccentrically positioned relative to the mid-span 18 of the main prestressed sinuous wire spring 14. The extent of the span or number of cross-bar members that are overlapped by the reinforcing member will vary in accordance with the length of the prestressed sinuous wire spring 14 and the ultimate desired firmness of the seat under load and it is contemplated that the span or extent of the auxiliary reinforcing member may vary for different applications and different sinuous spring loop configurations and wire gauges.

The clip ends 34 may vary depending upon the specific application and may include hooked or tipped ends which cooperate with openings in the rail sometimes referred to as Z-hook ends or tipped ends.

Figure 3:
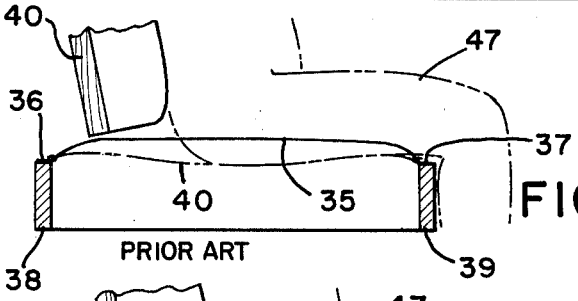
PRIOR ART FIG. 3
FIG. 3 is a schematic end view of a conventional seat frame with a conventional prestressed sinuous spring in the unloaded full line position and in the loaded broken line condition with a partial outline of an occupant illustrating the normal loaded deflection of a conventional prestressed sinuous spring secured at its ends to the front and rear rails of the furniture frame.

There is illustrated in FIG. 3, a typical or normal installation with a standard seat and a relatively shallow chair back 40 having a prearced or prestressed sinuous spring 35 secured by clip ends 36 and 37 on the rear and front rails 38 and 39 of the furniture seat frame in the unloaded upwardly arched condition of the spring. In the stressed or loaded condition of the spring 35 illustrated in a broken line form in FIG. 3 the outline of the bottom portion of an occupant 47 in the seated position is shown bearing upon the spring 35 which will be deflected downwardly to assume the depressed or loaded condition of the spring 35.

In FIG. 4, the front and rear rails 41 and 42 support the elongated prearced sinuous spring member 43 through the clips 44 and 45 mounted on the rear and front rails 42 and 41, respectively, with the spring 43 shown in greatly depressed upwardly extending arc 46 in outline form when it is subjected to the loading by the occupant 47 of which only a portion is shown in outline form in which the depressed arc 46 results from an overly deep ride with objectionable bucketing.

In FIG. 5, the same frame is utilized with the same spacing between the front and rear rails 41 and 42, as shown in FIG. 4, with the prearced sinuous wire spring 14 being utilized with the auxiliary reinforcing member 27 in the position as illustrated in FIGS. 1 and 2 in the full line form before loading and in the depressed loaded outline form 48 when stressed by the occupant 47 also shown partially in an outline form. The sinuous spring 14 is limited in its downward displacement and the curvature is restricted by utilization of the auxiliary reinforcing member 27 to provide the deep ride without objectionable bucketing.

It will be readily apparent that the auxiliary reinforcing member 27 will not present any obstruction or interference in the action of the sinuous spring 14 whether in relation to the upholstering or in the spring action other than as modified by the reinforcing member 27. The hinge link 22 and clip 25 employed in FIGS. 1 and 2 are incorporated in FIG. 5 for the rear rail and spring clip member 34 retains the terminal cross-bar of the sinuous spring member 14 to the front rail 41. The hinge link 22 provides some additional "ride," but it is not essential. Whether or not it is used depends on the desired seating action.

Various foam and other cushioning materials and appropriate upholstery fabric (not shown) will be employed with this construction recognizing that a plurality of spaced prearced sinuous wire strands 14 will be secured in substantially parallel spaced relationship to each other.

I claim:

1. A sinuous spring structure for furniture seating frames having spaced-apart front and rear rails comprising a prestressed sinuous wire spring having linear cross-bars connected by semicircular loops, said prestressed sinuous spring having terminal cross-bar ends, one of said terminal cross-bar ends being connected to said front rail and the other terminal cross-bar end being connected to said rear rail with the sinuous spring having a mid-span with an upwardly arching free span between said rails in the spring unloaded condition, an auxiliary downwardly contoured prestressed sinuous reinforcing member connected to spaced selected cross-bars of said sinuous spring and eccentrically spaced from either terminal cross-bar and beneath said sinuous spring controlling the elongation and bending of the sinuous spring connected to said auxiliary reinforcing member under a loaded condition and sinuous spring deflection whereby increased depth of seating without objectionable bucketing occurs as modified by said auxiliary reinforcing member relative to an unreinforced sinuous wire spring.

2. A sinuous spring structure as claimed in claim 1, at least one of said terminal cross-bar ends being pivotally connected to one of said rails.

3. A sinuous spring structure as claimed in claim 1, said terminal cross-bars being pivotally connected to said rails.

4. A sinuous spring structure as claimed in claim 1, a hinging link pivotally connected to said terminal cross-bar end connected to said rear rail.

5. A sinuous spring structure as claimed in claim 4, a spring clip attachment supported on said rear rail, said spring clip attachment retaining said hinging link therein.

6. A sinuous spring structure as claimed in claim 1, said auxiliary reinforcing member being resilient and having spaced-apart ends and means for connecting said reinforcing member ends to selected sinuous spring cross-bars for retaining said auxiliary reinforcing member in position under said sinuous wire spring and spaced from the terminal ends of said sinuous spring.

7. A sinuous spring structure as claimed in claim 1, said auxiliary reinforcing member being resilient and having spaced-apart cross-bar ends, said reinforcing member having a reach extending for at least four cross-bars of said prestressed sinuous spring, and means for connecting said reinforcing member ends to selected sinuous spring cross-bars for retaining said reinforcing member in position under said sinuous wire spring and spaced from the terminal ends of said sinuous wire spring.

8. A sinuous spring structure as claimed in claim 1, said auxiliary reinforcing member comprising a sinuous spring segment having cross-bars and connecting semicircular loops and cross-bars at the segment ends, said spring segment being securely connected to said prestressed sinuous spring at selectively spaced cross-bars thereon and extending downwardly beneath said prestressed sinuous spring.

9. A sinuous spring structure as claimed in claim 1, said auxiliary reinforcing member comprising a sinuous spring segment having cross-bars and connecting semicircular loops matching said prestressed sinuous spring and having a downwardly arched mid-span, said spring segment having cross-bars at the segment ends, and a clamping sleeve for securely retaining the spring segment cross-bar ends to selected cross-bars on said prestressed sinuous spring forming an overlapping span of said prestressed sinuous spring and said spring segment whereby the elastic characteristics of said overlapping span is modified from the prestressed sinuous spring without said spring segment.

10. A sinuous spring structure as claimed in claim 9, a hinging link pivotally connected to said terminal cross-bar and connected to said rear rail, and a spring clip attachment supported on said rear rail, and said spring clip attachment retaining said hinging link therein.

* * * * *